United States Patent [19]

Brouha et al.

[11] 4,379,251

[45] Apr. 5, 1983

[54] CATHODE-RAY TUBE

[75] Inventors: Marcel Brouha; Waltherus W. van den Hoogenhof; Peter C. van Loosdregt, all of Eindhoven, Netherlands

[73] Assignee: U.S. Philips Corporation, New York, N.Y.

[21] Appl. No.: 208,970

[22] Filed: Nov. 21, 1980

[30] Foreign Application Priority Data

Dec. 21, 1979 [NL] Netherlands ..... 7909232

[51] Int. Cl.[3] ..... H01J 29/07; H01J 31/20

[52] U.S. Cl. ..... 313/403; 313/408

[58] Field of Search ..... 313/403, 408

[56] References Cited

U.S. PATENT DOCUMENTS 2,579,665 12/1951 Green ..... 313/408

4,135,111 1/1979 Verweel ..... 313/403

*Primary Examiner*—Alfred E. Smith

*Assistant Examiner*—T. N. Grigsby

*Attorney, Agent, or Firm*—Robert J. Kraus

[57] ABSTRACT

In a cathode-ray tube for displaying colored pictures comprising in an evacuated envelope means to generate a number of electron beams, a display screen comprising a number of regions luminescing in different colors, and color selection means comprising a large number of apertures which assign each electron beam to luminescent regions of one color, in which color selection means a magnetic quadrupole field is generated to form a magnetic quadrupole electron lens in each aperture, which luminescent regions have the shape of substantially parallel strips the longitudinal direction of which is substantially parallel to the defocusing direction of the quadrupole lens, characterized in that the apertures are elongate, substantially hexagonal and symmetrical relative to their longitudinal axes and are situated with their longitudinal axes in a number of parallel rows which extend substantially parallel to the strips and the apertures of two juxtaposed rows are shifted relative to each other, it is possible, in spite of the large transmission of the color selection means, to obtain a display screen having very uniform phosphor strips.

4 Claims, 9 Drawing Figures

CATHODE-RAY TUBE

Figure 1:
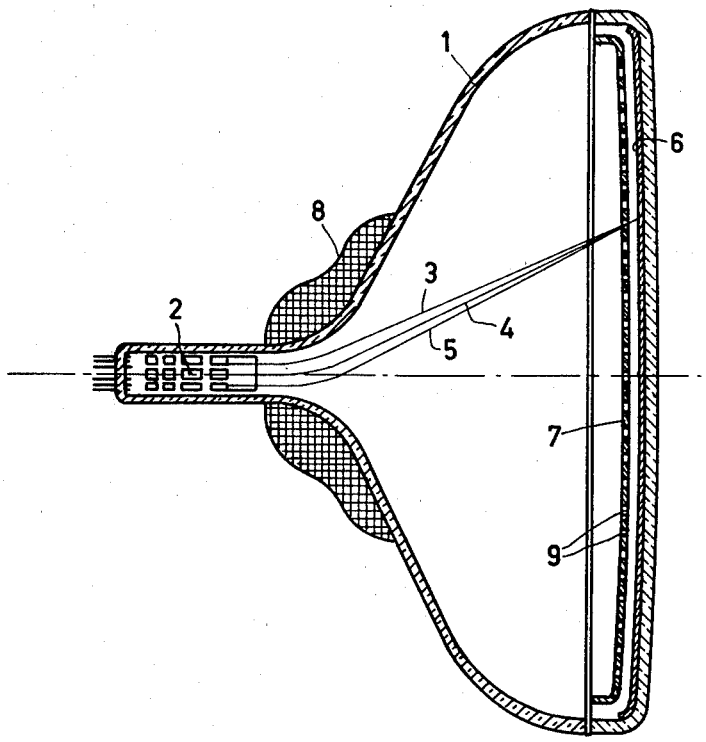

The invention relates to a cathode-ray tube for displaying coloured pictures comprising in an evacuated envelope means to generate a number of electron beams, a display screen comprising a large number of areas luminescing in different colours, and colour selection means comprising a large number of apertures which assign each electron beam to luminescent areas of one colour, in which colour selection means a magnetic quadrupole field is generated to form a magnetic quadrupole electron lens in each aperture, which luminescent areas have the shape of substantially parallel strips the longitudinal direction of which is substantially parallel to the defocusing direction of the quadrupole lenses.

Such a cathode-ray tube of the post-focusing type is disclosed in U.S. Pat. No. 4,135,111. The object of post-focusing is to increase the brightness of the displayed picture by increasing the transmission of the colour selection means. In tubes without post-focusing a very large part, for example 80 to 85%, of the electrons is intercepted by the so-called shadow mask. By using post-focusing the apertures in the colour selection means can be enlarged since as a result of the focusing in the apertures the electron spots on the screen are considerably smaller than the apertures so that nevertheless sufficient space is present between the electron spots of the various electron beams.

In comparison with axially symmetrical lenses, quadrupole lenses are comparatively very strong since the magnetic field is at right angles to the electron path so that a much smaller magnetization will suffice than in axially symmetrical lenses. That a quadrupole lens focuses in one direction and defocuses in the direction at right angles thereto is in principle no objection if all the quadrupoles have the same orientation. Therefore, the luminescent regions of the display screen have the shape of substantially parallel strips the longitudinal direction of which is substantially parallel to the defocusing direction of quadrupole lenses.

In the known cathode-ray tube the colour selection means have substantially square apertures of which a diagonal extends in the direction of the strips. Four magnetic poles which are cyclically magnetized north-south-north-south, are present on sides of the square apertures. The phosphor strips which together form the display screen, are provided, as usual, by means of a photographic method. The colour selection means are displayed on a photo-sensitive layer on the window portion of the tube. In connection with the large transmission of the colour selection means and the shape of the apertures the exposure method used must be suitable to display the aperture or other parts of the colour selection means in a strongly narrowed manner on the photosensitive layer. In the so far known cathode-ray tubes as described in U.S. Pat. No. 4,135,111 this has proved to be very difficult, which will be explained hereinafter. It is therefore an object of the invention to provide a cathode-ray tube in which post-focusing by means of magnetic quadrupole lenses is possible and in which equal phosphor strips can be obtained by means of a simple exposure method. According to the invention, a cathode-ray tube of the kind mentioned in the opening paragraph is characterized in that the apertures are elongate, substantially hexagonal and symmetrical with respect to their longitudinal axes and are situated with their longitudinal axes in a number of parallel rows which extend substantially parallel to the strips, and the apertures of two juxtaposed rows are shifted relative to each other. The colour selection means are formed by a ferromagnetic plate comprising the said apertures, which plate is magnetized so that along the edge of each aperture cyclically a north pole, a south pole, a north pole and a south pole are present. The colour selection means may also be formed by a non-ferromagnetic plate which is provided with the said apertures and with a layer of magnetizable material, which layer is magnetized so that along the edge of each aperture cyclically a north pole, a south pole, a north pole and a sourth pole are present. The corners of the hexagonal apertures are preferably rounded-off, which, electron-optically, is favourable.

Figure 2:
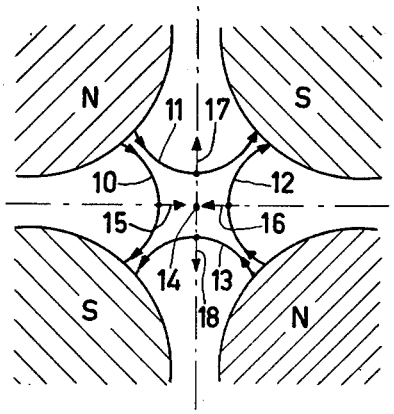
Figure 3:
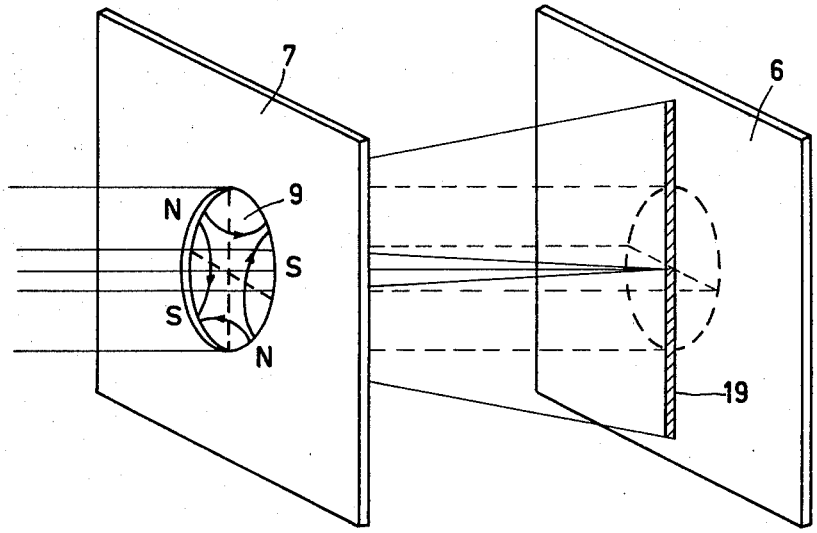
Figure 4:
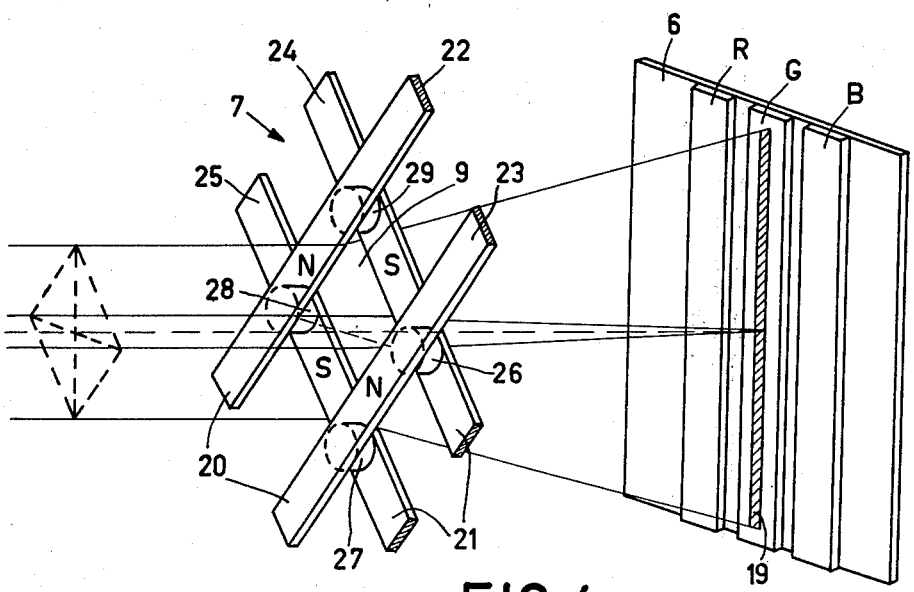
Figure 5A:
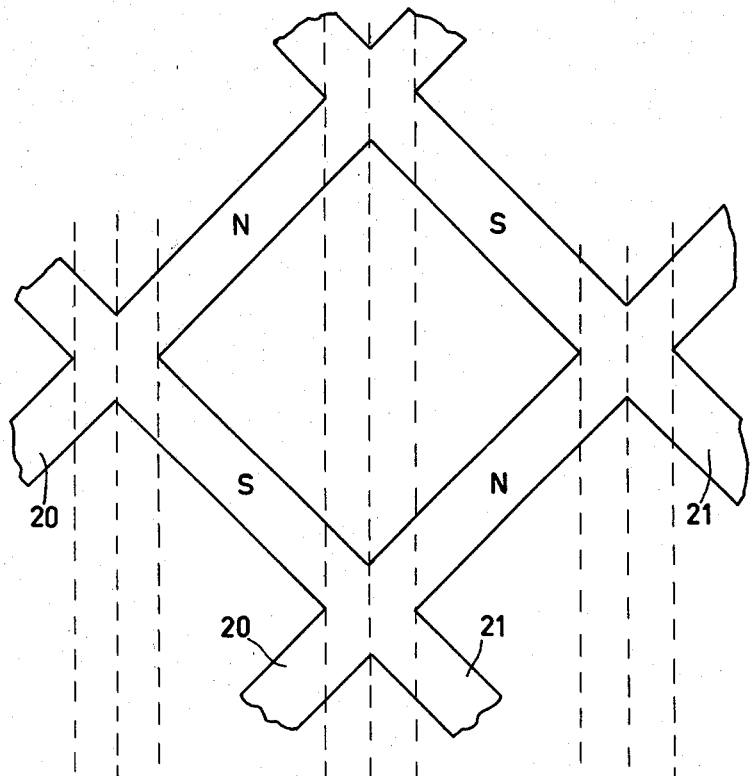
Figure 5B:
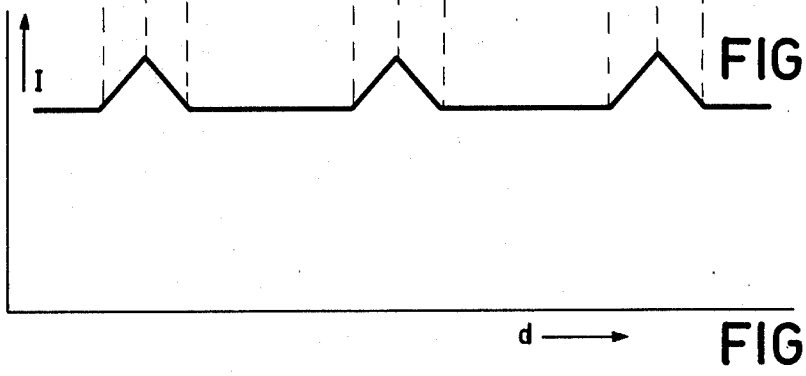
Figures 6A, 6B:
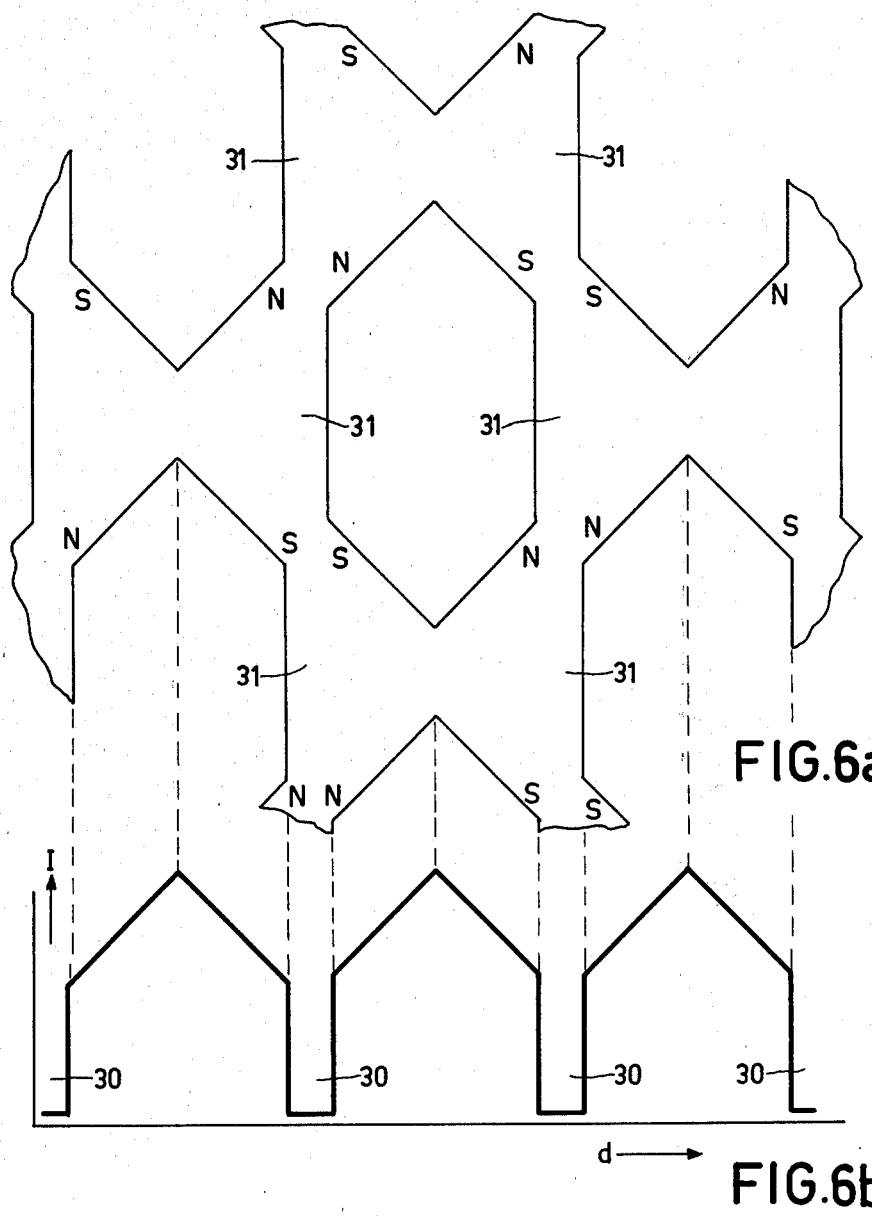

Why equal phosphor strips can be obtained by means of a cathode-ray tube according to the invention will be described in greater detail, by way of example, with reference to a drawing, of which FIG. 1 is a horizontal sectional view of a cathode-ray tube for displaying coloured pictures according to the invention, FIG. 2 explains the focusing by means of a magnetic quadrupole lense, FIG. 3 serves to explain the principle of the magnetic quadrupole focusing, FIG. 4 is a diagrammatic perspective view of prior art colour selection means placed in front of a display screen, FIG. 5*a* is an elevation of the colour selection means shown in FIG. 4, FIG. 5*b* shows the light intensity distribution behind the colour selection means during the exposure upon providing the phosphor strips, FIG. 6*a* is an elevation of the colour selection means according to the invention, FIG. 6*b* shows the light intensity distribution behind the colour selection means according to the invention during the exposure upon providing the phosphor strips.

Figure 7:
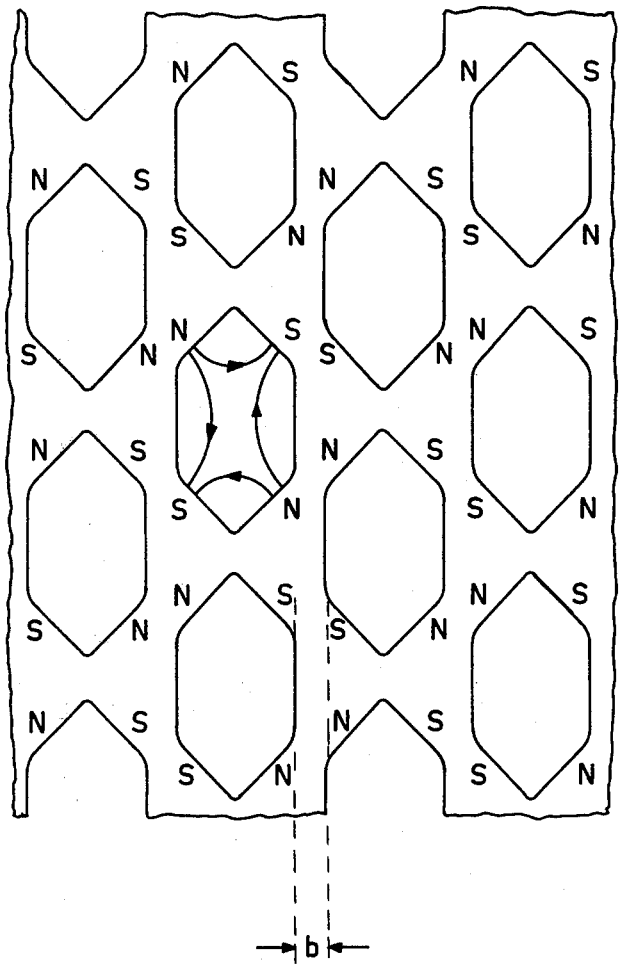

FIG. 7 is an elevation of the colour selection means according to the invention the apertures of which have rounded corners.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue and the longitudinal direction of which is perpendicular to the plane of the drawing of FIG. 1. During normal operation of the tube the phosphor strips are vertical and FIG. 1 hence is a horizontal sectional view of the tube. The colour selection means 7 which will be described in detail with reference to FIGS. 3, 4, 5, 6 and 7 comprise a large number of apertures 9 which are shown diagrammatically only in FIG. 1. The three electron beams 3, 4 and 5 pass through the apertures 9 at a small angle with each other and consequently each impinge only on phosphor strips of one colour. The apertures 9 in the colour selection means 7 are thus very accurately positioned with respect to the phosphor strips of the display screen 6. In the already mentioned U.S. Pat. No. 4,135,111, magnetic quadrupole lenses to focus the electron beams are formed in the apertures 9.

The known principle of the magnetic quadrupole lens is explained again with reference to FIG. 2. Four magnetic poles which are cyclically magnetized north-south-north-south (N-S-N-S) form a magnetic field of which a few field lines are referenced to 10, 11, 12 and 13. An electron beam the axis of which coincides with the axis 14 of the quadrupole lens and the electrons of which move backwards perpendicularly to the plane of the drawing experiences the focusing and defocusing forces denoted by the arrows 15, 16, 17 and 18. So the cross-section of the electron beam is extended in the vertical direction and is made narrower in the horizontal direction.

FIG. 3 shows diagrammatically such a magnetic quadrupole lens in an aperture 9 of the colour selection means 7. The variation of the magnetization along the edge of the aperture 9 is denoted by N, S, N, S in such manner that a quadrupole field is formed. The electron beam which passes through the aperture 9 is focused in the horizontally drawn plane and is defocused in the vertically drawn plane so that, when the display screen is present exactly in the horizontal focal point, the electron spot 19 is formed. It is recommandable not to focus exactly on the display screen 6 so that a slightly wider electron spot is formed on the display screen. It is only of minor influence on the focusing when the electron beam passes through the aperture 9 at a small angle as a result of which the colour selection of the three electron beams 3, 4 and 5 takes place in quite an analogous manner as in the said known shadow mask tube. As a result of the strong focusing, the aperture 9, however, can be much larger in the known shadow mask tube so that much more electrons impinge upon the display screen 6 and a brighter picture is formed. The defocusing in the vertical direction need not be a drawback when phosphor strips are used which are parallel to the longitudinal direction of the spot 19.

FIG. 4 shows the prior art colour selection means. These colour selection means 7 consist of a grid of two crossing sets 20 and 21 of parallel strips of soft magnetic material. The strips are connected together at the crossings by means of discs 26, 27, 28 and 29 of permanent magnetic material. The direction of magnetization of all the discs is perpendicular to the plane of the grid and in this embodiment is such that the north pole of the discs is directed towards the side of the electron gun and the south pole is directed towards the side of the display screen. Each set of parallel strips 20 and 21 comprises a large number of strips of which FIG. 4 shows only the strips 22 and 23 and 24 and 25, respectively, defining one of the many apertures 9 of the colour selection means 7. The strips 22 and 23 form the north poles and the strips 24 and 25 form the south poles of the quadrupole lens. This quadrupole lens focuses the electron beam in a horizontal direction and defocuses the electron beam in a vertical direction so that the elongate spot 19 is formed on the phosphor strip G consisting of a green luminescing phosphor. The other electron beams can display analogously an elongate spot on the phosphor strips R and B of a red and a blue luminescing phosphor, respectively. It will be obvious that the elongate spot 19 should impinge accurately on the phosphor strip in order to obtain a colour-pure picture. For this purpose it is necessary for the phosphor strips to be situated accurately behind the apertures in the colour selection means. In the known shadow mask colour display tubes the shadow mask itself is therefore always used as a template in photographically providing the phosphor strips on the inner side of the display window. In these known shadow mask tubes, however, the apertures were so narrow (approximately 185 μm) that the phosphor strips could be obtained by displaying rows of elongate apertures separated from each other by bridges on a photosensitive layer on the display screen by means of an elongate light source in the deflection point of the display tube. The length of the light source is chosen to be so that the light distribution behind the apertures and the bridges has a substantially homogeneous variation. Such an exposure technique is described elaborately in Netherlands Patent Application 7300484 laid open to public inspection. An exposure with such an elongate lamp through colour selection means shown in FIG. 4, however, results in a uniformly illuminated screen with lighter vertical stripes. This is the result of the large mask transmission.

FIG. 5*b* shows the light intensity variation I behind the colour selection means as shown in FIG. 5*a* as a function of the distance d along a horizontal axis over the display window. The contrast between the lighter vertical stripes and the remainder of the display screen is so small that it is very difficult to obtain good uniform phosphor stripes therewith. The invention provides a solution to this exposure problem by a suitable choice of the shape of the apertures in the colour selection means. FIG. 6*a* shows the shape of the apertures in the colour selection means according to the invention. In such apertures it is possible to obtain, in addition to a high transmission (±45%), good phosphor strips by means of the known photographic techniques. FIG. 6*b* shows the intensity variation I analogous to FIG. 5*b*. On the inside of the display window shadow lines 30 are obtained which can be converted into phosphor strips by means of a positively acting photographic printing system. For the positively acting printing system, for example, electrophotography may be chosen. So it is not the apertures in the colour selection means which during exposure upon providing the phosphor strips are displayed, but the material 31 between the rows of apertures. In such a hexagonal aperture it is in addition still possible to provide a good magnetic quadrupole lens in the aperture. FIG. 7 shows diagrammatically the variation of the field lines in such a hexagonal aperture. This aperture has rounded corners, which electron-optically is favourable. The hexagonal apertures are obtained in the usual manner by means of an etching process. The colour selection means as shown in FIG. 7 consist of a 150 μm thick plate of magnetizable material, for example, the known material Cu Ni CO or Cu Ni Fe. The length of the apertures is approximately 1340 μm and the width is approximately 510 μm. The desired width b of the material between two rows of apertures is approximately 300 μm. The transmission in this case is 42%. The apertures of two juxtaposed rows of apertures in this case are shifted relative to each other by half a pitch so as to prevent moiré. The pitch is the distance between the centres of two successive apertures in a row. After providing the apertures the plate is magnetized in such manner that the magnetic poles denoted by N and S in FIG. 7 are obtained. It is also possible to manufacture such colour selection means from a material which is used for magnetic recording (for example Ferroxdur consisting of $BaFe_{12}O_{19}$ a hard magnetic ferrite or 90% of cobalt and 10% of phosphor or 90% of nickel and 10% phosphor) on a non-ferromagnetic carrier of, for example, aluminium in which hexagonal apertures have been provided. The magnetization of such colour selection means is done, for example, as described in U.S. Pat. No. 4,135,111 by means of a kind of writing head having four poleshoes which are provided with coils through which electric current passes in the correct direction.

What is claimed is:

1. A cathode-ray tube for displaying coloured pictures comprising in an evacuated envelope means to generate a number of electron beams, a display screen comprising a large number of areas luminescing in different colours, and colour selection means comprising a large number of apertures which assign each electron beam to luminescent regions of one colour, in which colour selection means a magnetic quadrupole field is generated to form a magnetic quadrupole electron lens in each aperture, which luminescent regions have the shape of substantially parallel strips the longitudinal direction of which is substantially parallel to the defocusing direction of the quadrupole lenses, characterized in that the apertures are elongate, substantially hexagonal and symmetrical relative to their longitudinal axes and are situated with their longitudinal axes in a number of parallel rows which extend substantially parallel to strips, and the apertures of two juxtaposed rows are shifted relative to each other.

2. A cathode-ray tube as claimed in claim 1, characterized in that the corners of the hexagonal apertures are rounded-off.

3. A cathode-ray tube as claimed in claim 1 or 2, characterized in that the colour selection means are formed by a ferromagnetic plate having the said apertures, which plate is magnetized so that along the edge of each aperture cyclically a north pole, a south pole, a north pole and a south pole are present.

4. A cathode-ray tube as claimed in claim 1 or 2, characterized in that the colour selection means are formed by a non-ferromagnetic plate having the said apertures, and a layer of magnetizable material, which layer is magnetized so that along the edge of each aperture cyclically a north pole, a south pole, a north pole and a south pole are present.

* * * * *